United States Patent [19]

Hanna

[11] Patent Number: 4,538,750

[45] Date of Patent: Sep. 3, 1985

[54] CONVERTIBLE BED AND PACK FRAME

[76] Inventor: Kenneth V. Hanna, 445 S. Cranbrook Crossroads, Birmingham, Mich. 48010

[21] Appl. No.: 542,374

[22] Filed: Oct. 17, 1983

[51] Int. Cl.[3] ..... A45F 4/00

[52] U.S. Cl. ..... 224/156; 5/111; 5/114; 224/210

[58] Field of Search ..... 224/156, 153, 210; 5/111, 114

[56] References Cited

U.S. PATENT DOCUMENTS

| | | | |
|---|---|---|---|
| 2,964,222 | 12/1960 | Rainwater . | |
| 2,973,525 | 3/1961 | Holtzclaw | 5/111 X |
| 3,846,855 | 11/1971 | Silverthorne . | |
| 3,912,138 | 10/1975 | Pava . | |
| 4,056,857 | 11/1977 | Quantz | 5/112 |
| 4,251,015 | 2/1981 | Gale, Jr. | 224/154 |
| 4,286,739 | 9/1981 | Silcott et al. | 224/156 |

*Primary Examiner*—Stephen Marcus
*Assistant Examiner*—Robert Petrik
*Attorney, Agent, or Firm*—Basile, Weintraub & Hanlon

[57] ABSTRACT

A bed and pack frame is convertible between an elongated bed frame configuration and a nested pack carrying configuration. The frame includes first and second members, each having first and second spaced side rails. Interconnecting members depend from and interconnect the side rails of each of the first and second members into a rigid support structure. The first and second side rails are releasably interconnectable to form a coplanar bed support frame and are separable so as to be re-arranged in a nested pack carrying configuration.

12 Claims, 6 Drawing Figures

CONVERTIBLE BED AND PACK FRAME

BACKGROUND OF THE INVENTION

1. Field of the Invention

This invention relates, in general, to camping and hiking equipment and, more specifically, to frame structures which are convertible between various configurations to form different types of camping equipment and, more specifically, to frames which are convertible between bed, backpack, knapsack, carrying bag, etc., configurations.

2. Description of the Prior Art

In camping and hiking activities, a premium is placed on the use of lightweight, convertible structures for easily transporting a variety of articles, such as food, clothing, shelter etc., and which can be reassembled to construct various articles, such as beds, chairs, packs, tents, etc. Thus, backpacks or knapsacks have been constructed with a frame structure to which the pack or knapsack is secured during hiking which distributes the weight of the pack or knapsack evenly over the wearer and provides a convenient mounting structure for the pack or knapsack. Upon reaching the final destination, i.e., the campsite, the frame structure can be converted into a bed, cot, chair or other support structure to support the user above the ground in a reclining or seated position.

Such frame structures must, of necessity, be lightweight and easily convertible between the various configurations, such as a backpack support, bed support, etc. As such, frame structures for camping equipment must contain a minimum number of individual, separable components for the required lightweight, ease of transportation and easy and quick re-arrangement between the various support configurations.

A number of such convertible frame structures have been devised for use in camping and hiking activities which are convertible between pack, bed and tent configurations. However, such previously devised convertible frame structures have utilized a large number of separate, interconnectable members and releasable connectors to achieve the desired convertibility. Obviously, the use of a large number of separate members adds weight to the frame structure, detracts from the ease of transporting the carried equipment and complicates the assembly and re-arrangement process. Furthermore, if one of the many number of components is lost, the desired frame configuration may not be able to be constructed. Finally, the large number of components increases the time required to reconfigure the frame between pack and bed configurations. All of these deficiencies have hindered the widespread use of such previously devised convertible camping and hiking frames.

Thus, it would be desirable to provide a lightweight convertible frame for camping and hiking activities which is easily and quickly convertible between a variety of supporting frame configurations. It would also be desirable to provide a frame which is convertible between an elongated bed support configuration and a backpack or knapsack carrying configuration. It would also be desirable to provide a convertible frame for camping and hiking activities which includes a minimum number of interconnectable components. It would also be desirable to provide a convertible frame for camping and hiking activities which minimizes the need for separate connectors for the various components of the frame structure and the time required to erect and dissemble such components.

SUMMARY OF THE INVENTION

The present invention is a bed and pack frame structure which is convertible between backpack, knapsack and elongated bed supporting configurations.

The convertible frame of the present invention includes first and second members, each having first and second spaced side rails. First and second interconnecting members depend from and interconnect the side rails of each of the first and second members to form rigid support structures.

In a preferred embodiment, the first and second interconnecting members are formed of first and second legs which depend from and are joined to one end of each of the first and second side rails of the first and second members and an integral cross member which spans and is joined to the depending leg members.

Preferably, the first member includes a second interconnecting member formed of opposed legs and a cross member joined to an opposite end of the first and second side rails of the first member.

The first and second side rails of the second member have a smaller cross section than the corresponding side rails of the first member so as to enable the side rails of the second member to be slidingly inserted into the side rails of the first member to form an elongated bed frame support structure. In addition, the first and second members may be re-arranged in a nested position with the side rails disposed in a side-by-side arrangement to form a compact frame for receiving and supporting a backpack or knapsack.

Alternately, a third member having spaced legs and an interconnecting cross member is engagable with the side rails of the second member. The legs of a third member have a smaller cross section than the cross section of the side rails of the second member so as to enable the legs of the third member to be slidingly inserted into the side rails of the second member and to enable the extension of the third member with respect to the second member to be varied in both the bed and backpack configurations.

The convertible bed and pack frame of the present invention overcomes many of the problems associated with previously configured backpack/bed frame convertible structures due to its use of a minimal number of individual components and special connectors. The minimal number of components enables the convertible frame of the present invention to be easily and quickly reconfigured between an elongated bed frame support configuration and a nested backpack or knapsack frame support configuration.

BRIEF DESCRIPTION OF THE DRAWING

The various features, advantages and other uses of the present invention will become more apparent by referring to the following detailed description and drawing in which.

DESCRIPTION OF THE PREFERRED EMBODIMENTS

Figure 1:
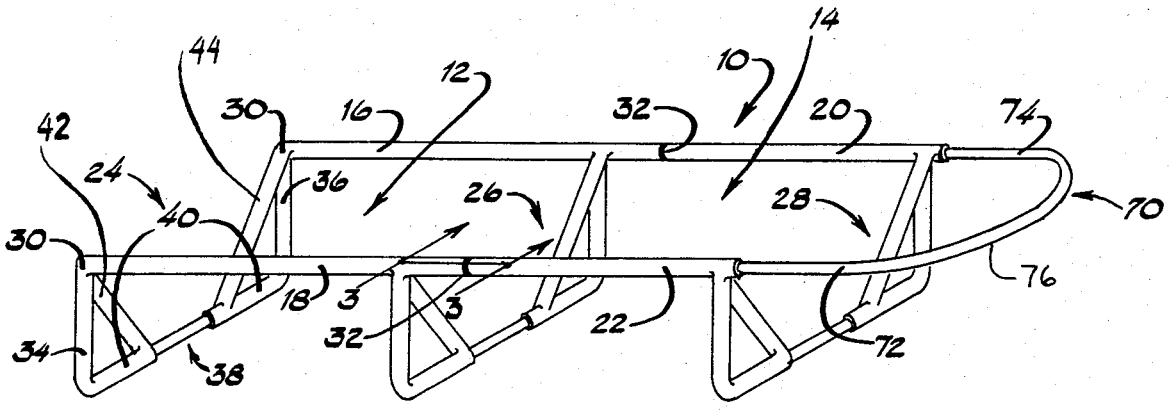
FIG. 1 is a perspective view of the convertible bed and pack frame of the present invention as shown in the elongated bed frame configuration.

Throughout the following description and drawing, an identical reference number is used to refer to the same component shown in multiple figures of the drawing.

Referring now to the drawing, there is illustrated a convertible bed and frame structure 10 for use in camping and hiking activities which is convertible between a variety of configurations for use as a bed or cot support frame structure or a backpack or knapsack support structure.

As shown in FIGS. 1–6, the convertible frame structure 10 includes first and second members 12 and 14, respectively. Each of the first and second members 12 and 14 includes first and second spaced, co-planar side rails, such as first and second side rails 16 and 18, respectively, in the first member 12 and first and second side rails 20 and 22 respectively, in the second member 14.

The first and second side rails 16, 18, 20 and 22 of the first and second members 12 and 14, respectively, are identically formed of rod-like members of any suitable cross section, such as circular, square, T-shaped, I-beam, etc.

Interconnecting means are provided for interconnecting the spaced side rails of each of first and second members 12 and 14. The interconnecting means depends from and is joined to the spaced side rails of each of the first and second members 12 and 14 so as to interconnect the spaced side rails into a rigid support structure. In a preferred embodiment, the first member 12 is provided with at least a first and, preferably, first and second interconnecting means 24 and 26, respectively; while the second member 14 has a single interconnecting means 28 secured thereto.

Figure 2:
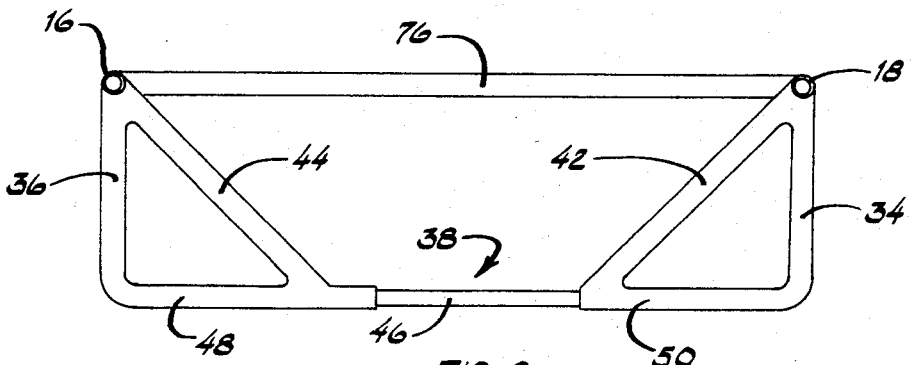
FIG. 2 is a left hand end view of the convertible frame shown in FIG. 1.

As shown in FIGS. 1 and 2, the first and second interconnecting means 24 and 26 are attached to the spaced first and second side rails 16 and 18 of the first member to connect the spaced side rails 16 and 18 of the first member 12 to a rigid support structure.

Figure 4:
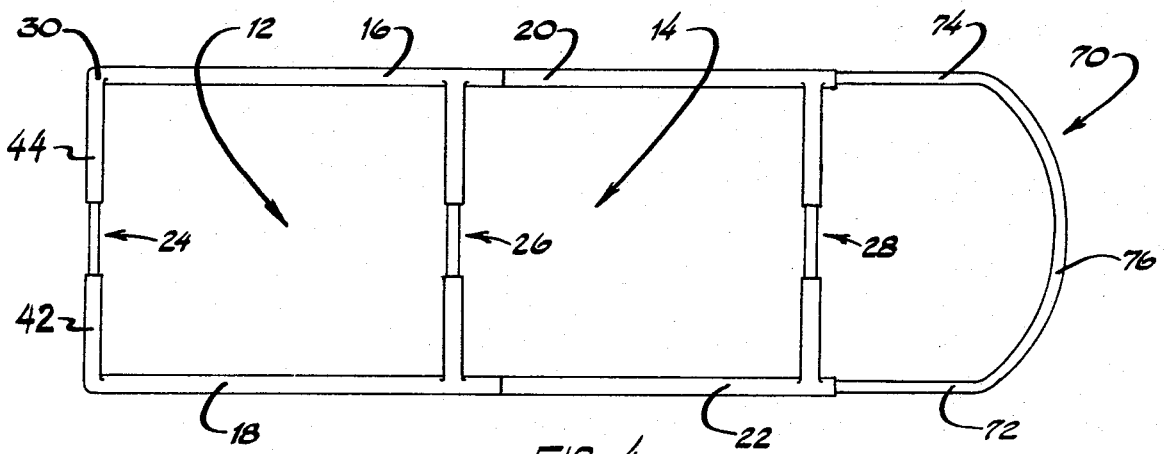
FIG. 4 is a plan view of the convertible frame shown in FIG. 1.

Generally, the interconnecting means 24 and 26 includes depending portions 34 and 36 which depend from and an are joined to the spaced side rails 16 and 18, and interconnecting cross member or portion 38 which extends between and is joined to the depending portions 34 and 36. As illustrated in FIGS. 1 and 4, the first interconnecting means 24 is mounted to the first end 30 of the side rails 16 and 18. The second interconnecting means 26, meanwhile, is mounted on the opposite end of the side rails 16 and 18 a short distance inward from the second end 32 of the side rails 16 and 18.

In a preferred embodiment, the depending portions 34 and 36 define legs which are joined at a top end of and depend from the first ends 30 of the first and second side rails 16 of the first member 12. The interconnecting or cross member 38 comprises an elongated, tubular rod 40 which is joined to and extends between the bottom end of the depending portions or legs 34 and 36. A pair of angular support members 42 and 44 are joined to and extend angularly between the depending leg portions 34 and 36 and the cross member 38, respectively, for added rigidity.

Figure 5:
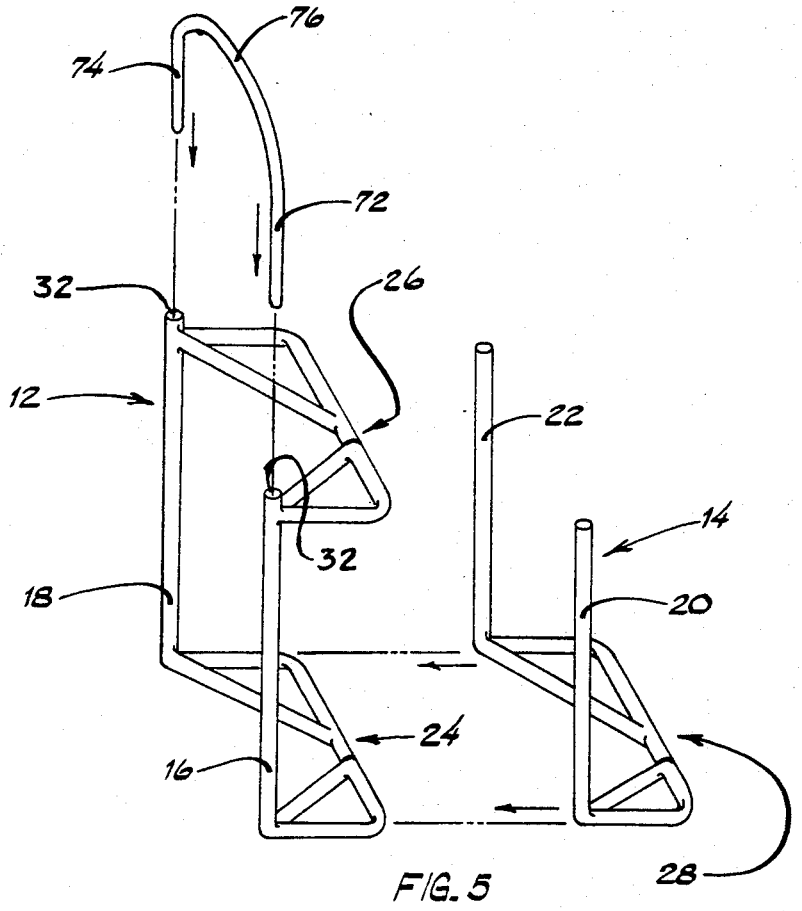
FIG. 5 is an exploded, perspective view of the convertible frame of the present invention showing its nesting backpack configuration.
Figure 6:
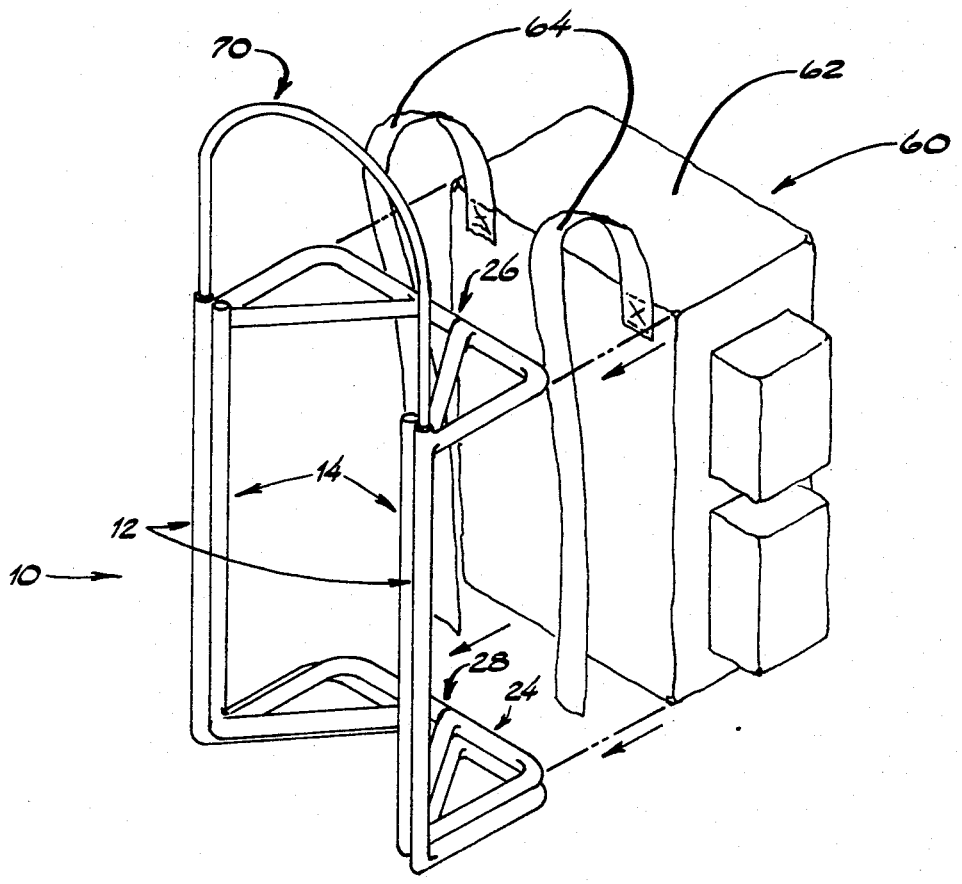
FIG. 6 is an exploded, perspective view of the convertible frame of the present invention in the backpack configuration for mounting a backpack thereon.

In a preferred embodiment, the interconnecting means 24 and 37 are adjustable in length so as to enable the spacing between the spaced side rails 16 and 18 of the first member 12 to be varied, as described in greater detail herafter. As shown in FIG. 2, the cross member 38 is formed of a hollow, tubular rod having a circular or square configuration which is divided into two separable portions 48 and 50. An interconnecting pin 46 is removably or permanently mounted in one of two first and second portions 48 and 50 of the cross member 38. The pin 46 has a diameter slightly less than the inner diameter of the first and second portions 48 and 50 of the cross member 38 so as to slidingly receive one of the cross member portions, such as cross member portion 50, as shown in FIG. 2, thereover. In this manner, the spacing between the side rails 16 and 18 of the first member 12 may be expanded to form the elongated bed configuration shown in FIG. 1 or urged together to form a nested backpack configuration as shown in FIGS. 4, 5 and 6 and described in greater detail hereafter.

It should also be noted that the interconnecting means 24 and 26 may have other configurations than that depicted by FIGS. 1 and 2 and described above. Thus, for example, the interconnecting means may comprise a curved or arcuately shaped member, V-shaped members having depending outer legs, etc. All that is necessary is that interconnecting means rigidly connect the spaced side rails of the first member 12 and provide a secure, non-rockable base for the convertible frame 10.

The second member 14 has a similar configuration as that described above for the first member 12. The second member 14 includes first and second, spaced side rails 20 and 22, respectively, which have essentially the same configuration as the side rails 16 and 18 of the first member 12. In one embodiment, the first and second side rails 20 and 22 of the second member 14 have a smaller diameter or cross section than the diameter or cross section of the side rails 16 and 18 of the first member 12. Specifically, the diameter of the first and second side rails 20 and 22 is selected to slidingly mate with the inner diameter of the hollow tubular side rails 16 and 18 of the first member 12. In this manner, the different diameters of the side rails of the first and second members 12 and 14 define means for interconnecting the side rails of the first and second members 12 and 14 into the elongated bed configuration shown in FIG. 1.

Figure 3:
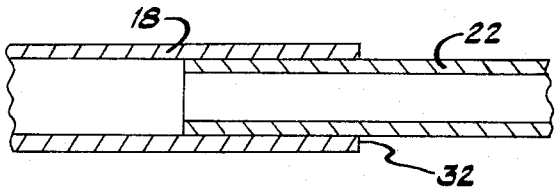
FIG. 3 is a cross sectional view, generally taken along line 3—3 in FIG. 1.

The reduced diameter construction of the side rails 20 and 22 of the second member 14 and their sliding interconnection with the aligned side rails 16 and 18 of the first member 12 are shown more clearly in FIG. 3. As shown in FIG. 3, one end of the side rails, such as side rail 22 of the second member 14, is slidingly inserted into the second end 32 of the aligned side rail 18 of the first member 12. In order to limit inward movement of the second side rail 22 within the first side rail 18, an internal stop, not shown, may be provided within the interior of the side rail 18 or the side rail 22 may have a gradually increasing tapered configuration so as to extend inward within the side rail 18 only a short predetermined distance. Also suitable connectors, such as aligned apertures formed in the aligned side rails 16 and 20, and 22 and interconnecting key pins may also be utilized to secure the side rails of the first and second members 12 and 14 in elongated bed configuration shown in FIG. 1.

The interconnecting means 28 is identical to the interconnecting means 24 and 26 described above and is joined to one end of the first and second side rails 20 and 22 of the second member 14.

As shown in FIG. 4, the side rails 16, 18, 20 and 22 of the first and second members 12 and 14 have a tapered, narrowing orientation. That is, the side rails taper inwardly from the first end 30 of the first member 12 to the opposite end of the second member 14 when the first and second members 12 and 14 are arranged in the elongated bed support configuration. It will also be understood, however, that the side rails may have other configurations, such as parallel, etc.

The first and second members 12 and 14 can be formed of any suitable lightweight, high strength material, such as aluminum, titanium, a high strength plastic, such as a composite graphite plastic, etc. Depending upon the particular material chosen for forming the first and second members 12 and 14, the configuration of the convertible frame structure 10 may be varied to take advantage of the particular material characteristics and attendant manufacturing processes.

It should also be noted that although the first and second members 12 and 14 are described and illustrated as being slidingly engageable, other means for interconnecting the first and second members 12 and 14 together may also be employed. Thus, for example, tongue and groove connectors may be formed on the mating ends of the first and second members 12 and 14 for easy engagement and disengagement of the first and second members 12 and 14. Furthermore, it is also possible to construct the side rails of the first and second members 12 and 14 such that the side rails of the second member 14 have a larger diameter or cross section than the diameter or cross section of the side rails 16 and 18 of the first member 12. Also, the diameters of the side rails of the first and second members 12 and 14 may be identical, with reduced diameter portions being formed at the mating ends to enable the first and second members to be slidingly interconnected.

Although the interconnecting means 24, 26 and 28 mounted on the first and second members 12 and 14 are illustrated as having the same, identical height, it is also feasible to construct the interconnecting means 26 with a height greater than the height of the outer interconnecting means 24 and 28. This will raise the center portion of the frame 10 higher than the outer ends of the frames 10 so as to fit the curvature of the back of an individual laying on the frame 10.

When the frame 10 is arranged in the bed configuration shown in FIG. 1, a sheet of flexible material, such as nylon cloth, etc., can be attached by suitable fasteners to the aligned side rails of the first and second members 12 and 14 to form a bed to support the user confortably above the ground.

Referring now to FIGS. 5 and 6, the convertible bed and pack frame 10 of the present invention may also be reconfigured into a pack. Configuration for attaching or carrying a pack, such as a backpack, knapsack, carrying bag, etc.,.

In reconfiguring the frame 10 from the elongated bed configuration shown in FIG. 1 into a nested pack configuration shown in FIG. 6, the first and second members 12 and 14 are initially separated. The second member 14 is the mounted within the first member 12 between the interconnecting means 24 and 26. In a preferred embodiment, the spacing between the side rails 20 and 22 of the second member 14 is made smaller than the spacing between the side rails 16 and 18 of the first member 12 such that the side rails 16, 18, 20 and 22 are in a common plane when in the nested position.

In addition, clamps, straps, etc. may be used, if desired, to maintain the adjacent side rails of first and second members 12 and 14 in the nesting configuration shown in FIG. 5. In this configuration, as shown more clearly in FIG. 6, the nested first and second members 12 and 14 of the convertible frame 10 provide a convenient support structure for mounting a conventional pack 60, such as a backpack, knapsack, etc., thereon for hiking activities.

Any conventional pack 16 may be mounted on the convertible frame 10 of the present invention. In general, such a pack 60 would include an enclosure portion 62 and one or more mounting straps 64 which receive the shoulders of the wearer. The pack 60 itself may be mounted on the frame 10 in any conventional manner, such as by use of snaps, zippers, or other suitable fasteners. Furthermore, the pack 60 may be mounted between the spaced interconnecting means 24 and 26 on the nested frame 10 to provide additional support for the pack 60 and to evenly distribute the weight of the pack 60 across the back and shoulders of the wearer.

It will also be understood that the frame 10, when in the nested configuration shown in FIG. 6, may be inserted directly into a carrying bag, etc., without supporting the bag for use solely as a back or carrying pack structure.

As shown in FIGS. 1, 2, 4, 5 and 6, the convertible frame 10 of the present invention also includes an interconnectable third member 70 which is releasably interconnected with the side rails 20 and 22 of the second member 14 in the elongated bed configuration shown in FIG. 1 or the side rails 20 and 22 of the first member 12 in the nested pack configuration shown in FIGS. 5 and 6.

The third member 70 is essentially U-shaped and has first and second spaced legs 72 and 74, respectively, and an integral, interconnecting central portion 76. The third member 70 is formed of a tubular rod which is bent or configured into the desired shape shown in FIGS. 1 and 5. Further, the cross section of the third member 70 is slightly smaller than the inner cross section of the hollow, tubular, side rails 20 and 22 of the second member 14 so as to be slidingly insertable therein. In this manner, the outer extension of the central portion 76 of the third member 70 may be adjustably varied with respect to the ends of the side rails 20 and 22 of the second member 14 to form an elongated support at the end of the bed configuration shown in FIG. 1.

Further, in the nested configuration, the third member 70 may be inserted in the opposite ends of the side rails 20 and 22 of the second member 14 or the side rails 16 and 18 of the first member 12 to form an upper support, as shown in FIG. 6, for receiving and carrying additional articles above the pack 60.

It should also be noted that the third member 70 is formed of an integral shape having the spaced legs 72 and 74 joined by an integral central portion 76. As the third member 70 is formed of a bendable, high strength metal or plastic, the outer ends of the spaced legs 72 and 74 may be bent so as to be slidingly inserted in the ends of the side rails 20 and 22 of the second member 14, as shown in FIG. 4. Although not shown, the third member 70 may also be formed so as to be adjustable in width in the same manner as that described above for the interconnecting members 24, 26 and 28 shown in FIG. 3 by means of an interconnecting pin mounted between two separable sections of the central portion 76 of the third member 70.

In summary, there has been disclosed a unique convertible bed and pack frame for use in camping and hiking activities which is easily and quickly convertible between an elongated bed configuration which supports the user above the ground and a nested pack configuration for carrying packs during hiking. The convertible frame of the present invention is composed of a minimal number of components which can be easily re-arranged between the bed and pack configurations without time consuming effort or the use of special, separate connectors. The minmal number of components also contribute to a lightweight frame and a low manufacturing cost.

What is claimed is:

1. A convertible bed and pack frame comprising:

first and second members, each having first and second spaced side rails, each of the first and second side rails each having first and second ends;

first means depending form and interconnecting the first and second rails of the first member;

second means depending from and interconnecting the first and second side rails of the second member; and wherein the first and second side rails of the first and second members are detachably re-arrangeable between a nested side-by-side pack carrying configuration and a co-axial bed frame configuration in which the first ends of the first and second side rails are directly interconnected.

2. The convertible bed and pack frame of claim 1 wherein each of the first and second interconnecting means comprises:

an interconnecting member depending from and extending between the first and second side rails to support the first and second side rails above the ground.

3. The convertible bed and pack frame of claim 2 wherein the first interconnecting means comprises a pair of interconnecting means mounted adjacent to the first and second ends of the first member.

4. The convertible bed and pack frame of claim 1 wherein each of the first and second interconnecting means comprises:

first and second spaced legs depending from and joined to the first and second side rails; and a cross member interconnecting the bottom portions of the first and second legs.

5. The convertible bed and pack frame of claim 1 wherein the first and second interconnecting means further includes:

means for adjusting a length of at least one of the first and second interconnecting means so as to adjustably vary the spacing between the first and second side rails of at least one of the first and second members.

6. The convertible bed and pack frame of claim 5 wherein each of the first and second interconnecting means include means for adjusting the length of the first and second interconnecting means.

7. The convertible bed and pack frame of claim 5 wherein the means for adjusting the length of at least one of the first and second interconnecting means comprises:

the interconnecting means having a hollow tubular configuration with first and second separable portions, each connected to one of the first and second side rails, and connector means mountable within one of the first and second separable portions of the interconnecting means and adapted to be adjustably and slidingly received within the other of the separable portions of the interconnecting means so as to selectively vary the length of the interconnecting means.

8. The convertible bed and pack frame of claim 1 wherein:

the first and second side rails of the first and second members have a hollow tubular configuration, with the first and second side rails of the first member having a different cross section than the cross section of the first and second side rails of the second member so as to enable the ends of the first and second side rails of the first member to be slidingly inserted into the ends of the first and second side rails of the second member.

9. The convertible frame of claim 1 further including:

a third member releasably interconnectable with one end of the first and second side rails of the second member in either of the bed support configuration or the nested pack configuration.

10. The convertible frame of claim 9 wherein the third member comprises:

a U-shaped member having opposed leg portions and an interconnecting central member, the opposed leg portion being slidingly inserted within the ends of the first and second side rails of the second member.

11. A convertible bed and pack frame comprising:

first and second members, each having first and second spaced side rails, each of the first and second side rails each having first and second ends;

first means depending from and interconnecting the first and second side rails of the first member;

second means depending from and interconnecting the first and second side rails of the second member; and means for releasably connecting first and second side rails of the first and second members into a co-axial interconnected bed frame configuration, the first and second side rails of the first and second members being separable and re-arrangeable in a nested side-by-side pack carrying configuration;

the first and second side rails of the first and second members having a tubular configuration;

the first and second side rails of the first member having a hollow first cross section;

the first and second side rails of the second member having a second cross section different than the first cross section of the first and second side rails of the first member and adapted to be telescopingly inserted within the first end of the first and second side rails fo the first member for directly interconnecting the first and second side rails of the first and second members into an elongated bed support frame.

12. A convertible bed and pack frame comprising:

first and second members, each having first and second spaced side rails with first and second spaced ends;

a first pair of interconnecting means depending from and interconnecting first and second side rails of the first member;

a second interconnecting means depending from and interconnecting the first and second side rails of the second member;

each of the first pair and second interconnecting means including:

opposed, depending leg portions joined to the first and second side rails and depending downward therefrom; and a cross member extending between and joined to the bottom ends of the depending leg portions;

means for adjusting the length of the first paid and second interconnecting means, the adjusting means including:

the cross member having first and second separable portions, each joined to one of the depending leg portions of the interconnecting means; and a connector mountable within one of the first and second separable portions of the cross member and adapted to be adjustably and slidingly received within the other of the first and second separable portions of the cross member so as to selectively vary the length of the interconnecting means; and means for directly interconnecting the first and second side rails of the first and second members into a co-axially interconnected bed frame configuration, the first and second members being separable and re-arrangeable into a nested pack carrying configuration.

* * * * *